US006022024A

United States Patent [19]

Kahn

[11] Patent Number: 6,022,024

[45] Date of Patent: Feb. 8, 2000

[54] UNDERWATER DART BOARD GAME

[76] Inventor: Louis F. Kahn, 249 S. Swall Dr., Beverly Hills, Calif. 90211

[21] Appl. No.: 09/205,030

[22] Filed: Dec. 4, 1998

[51] Int. Cl.[7] ..... A63B 63/00

[52] U.S. Cl. ..... 273/317; 273/350; 473/476; 473/466

[58] Field of Search ..... 273/317, 351, 273/348, 359, 236, 148 R, 287, 410, 350; 473/585, 115, 476, 466; 446/4

[56] References Cited

U.S. PATENT DOCUMENTS

| | | | |
|---|---|---|---|
| 619,762 | 2/1899 | Kissinger et al. | 473/585 |
| 3,014,723 | 12/1961 | Butler | 273/102 |
| 3,403,907 | 10/1968 | Keller | 273/95 |
| 3,430,958 | 3/1969 | Lakeman | 273/105 |
| 3,652,090 | 3/1972 | Semmens | 273/104 |
| 3,672,678 | 6/1972 | Rizzo | 473/585 |
| 3,891,214 | 6/1975 | Scullin | 273/408 |
| 3,982,762 | 9/1976 | Milicic | 473/585 |
| 4,127,271 | 11/1978 | Moustakas | 273/100 |
| 4,257,613 | 3/1981 | Meyer Thor Straten | 473/574 |
| 4,281,836 | 8/1981 | Black | 273/408 |
| 4,887,822 | 12/1989 | Tsai | 473/585 |
| 4,997,190 | 3/1991 | Chmela | 473/585 |
| 5,016,891 | 5/1991 | Nelson | 273/407 |
| 5,067,728 | 11/1991 | Dadbeh | 473/585 |
| 5,112,062 | 5/1992 | Pratt | 473/585 |
| 5,290,041 | 3/1994 | Kettelson | 273/400 |
| 5,421,585 | 6/1995 | Ruvio | 273/338 |
| 5,897,116 | 4/1999 | Yia | 273/408 |
| 5,928,049 | 7/1999 | Hudson | 446/4 |

*Primary Examiner*—Jeanette Chapman
*Assistant Examiner*—M. Chambers
*Attorney, Agent, or Firm*—Oppenheimer Wolff & Donnelly LLP

[57] ABSTRACT

An underwater dart board game which includes a dart board that may be thrown into a pool and settles on the bottom. The dart board has target areas thereon and a plurality of weighted darts are provided for throwing in the water on top of the dart board.

9 Claims, 1 Drawing Sheet

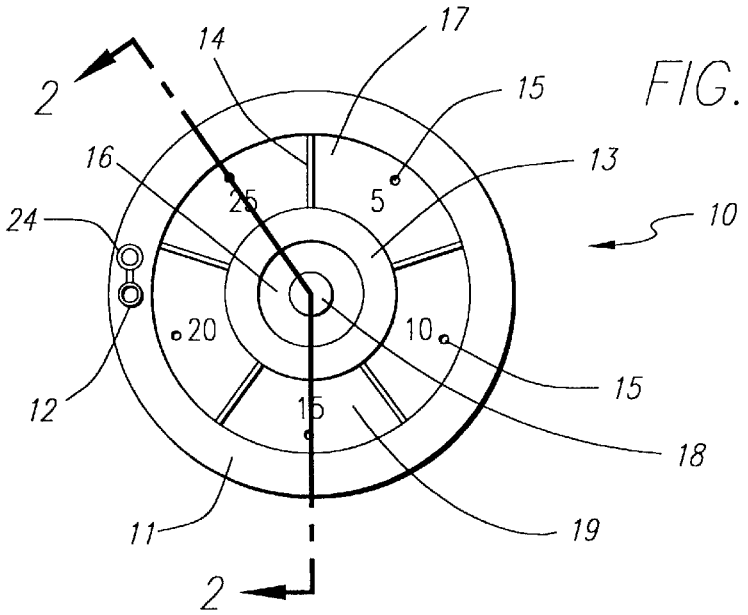
FIG. 1
FIG. 2
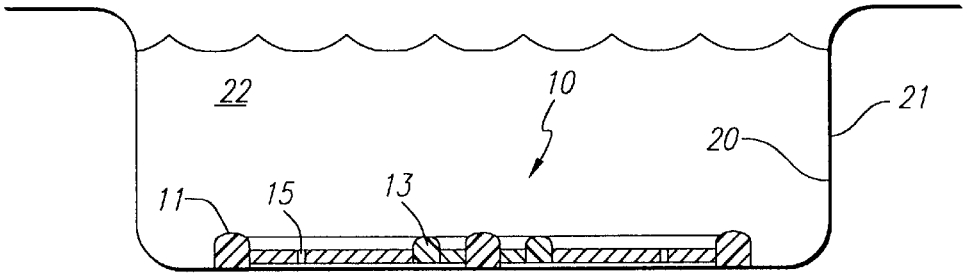
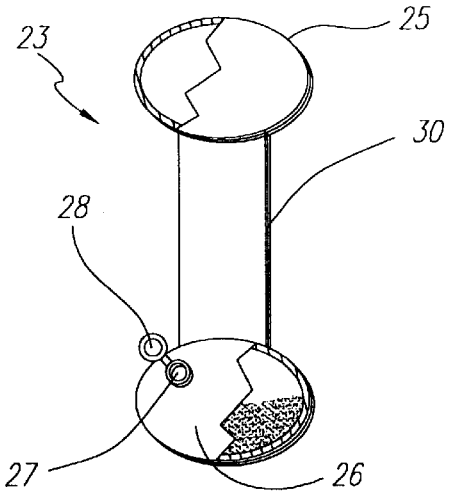
FIG. 3
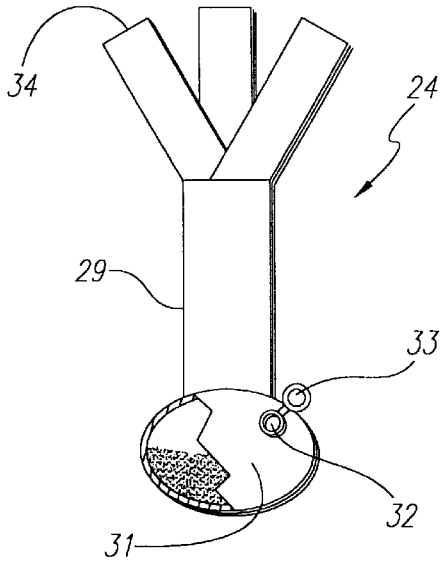
FIG. 4

UNDERWATER DART BOARD GAME

BACKGROUND OF THE INVENTION

1. Field of the Invention

The invention relates to an amusement device; and, more particularly a pool toy in the form of a submersible dart board and darts therefor.

2. Related Art

Many types of amusement devices for swimming pools are known. Dart boards are extremely popular but none are known which can be used in a pool. It is not obvious to throw a conventional dart board into a pool. Even if it should occur to someone to throw a conventional dart board into a pool, such boards are usually made of cork or the like, will float on the surface, not sink to the bottom or be corroded by the pool water. Conventional darts thrown into the pool would float, since they are lightweight, or otherwise not reach the target.

There is thus a need for a pool toy in the form of a submersible dart board and darts therefore.

SUMMARY OF THE INVENTION

It is an object of this invention to provide a submersible dart board game.

It is a further object of this invention to provide a dart board that, when thrown in a pool, rests on the pool bottom and weighted darts therefor.

These and other objects are preferably accomplished by providing an underwater dart board game which includes a dart board that may be thrown into a pool and settles on the bottom. The dart board has target areas thereon and a plurality of weighted darts are provided for throwing in the water on top of the dart board.

BRIEF DESCRIPTION OF THE DRAWING

FIG. 1 is a top plan view of a dart board in accordance with the teachings of the invention;

FIG. 2 is a side view of a swimming pool showing the dart board of FIG. 1 resting on the bottom thereof;

FIG. 3 is an elevational view of a weighted dart used with the dart board of FIG. 1; and FIG. 4 is an elevational view of another weighted dart to be used with the dart board of FIG. 1.

DESCRIPTION OF THE PREFERRED EMBODIMENT

Referring now to FIG. 1 of the drawing, a dart board 10 is shown having an outer annular hollow tubing 11 having a closable opening 12 therein. A second annular tubing 13 is provided spaced from tubing 11. Tubing 13 may be solid and both tubings 11, 13 are interconnected by a plurality of spaced radially extending ribs 14. The area 16 inside tubing 13 may be solid as is the area 17 between tubings 11, 13. A plurality of air holes 15 are provided at least in area 17 so that, when thrown in the pool, dart board 10 sinks to the bottom. A center target or bulls-eye 18 is provided in the center of board 10. The segmented areas between spaced ribs 14 and the inner and outer tubings 11, 13 may have suitable scoring indicia 19 thereon, such as scoring numbers five, ten, fifteen, twenty, and twenty-five.

Sand may be inserted into tube 11 through opening 12. The opening 12 can then be closed off by attached cap 24. This gives weight to dart board 10 so it immediately sinks to the bottom of the pool (see FIG. 2). Using sand allows one to adjust the weight of the dart board 10.

As seen in FIG. 2, dart board 10 is shown disposed on the bottom 20 of pool 21. When thrown into the water 22 in pool 21, it rapidly sinks to the bottom.

Darts 23, 24, shown in FIGS. 3 and 4 respectively, may now be thrown from outside pool 21 onto board 10. Dart 23, shown in FIG. 3, may have a main tube portion 30, solid or hollow, having round globes 25, 26 at each end. Globe 25 may be hollow (air filled and sealed off from tube 24) whereas globe 26 may have an opening 27 closable by cap 28 so it can be filled with sand. This allows weighted globe 26 to fall downwardly and onto target 10 (staying in the upright position shown in FIG. 3).

Dart 24 may have a tubular main body portion 29, hollow or solid, having a globe 31 at one end identical to globe 26 and also having a similar opening 32 for filling the same with sand closable by attached cap 33. The opposite end of dart 24 may have a plurality of spaced feathers 34 integral with body portion 29. Again, dart 24 is adapted to be thrown from outside pool 21 on top of dart board 10.

Scoring of course is similar to scoring of conventional dart board games. Although only one board face is shown in FIG. 1, obviously another game, such as baseball well known in the art, may be provided on the opposite side.

The style of darts may be varied and any suitable configuration of dart board 10 may be used. For example, although shown as round, it may be octagonal, square, etc.

Although only tubing 11 is disclosed as fillable with sand, tubing 13, if desired, may also be hollow and fillable with sand through a closable opening.

Any suitable materials, such as plastics, metal, etc. may be used.

Although a preferred embodiment of the invention is disclosed, variations thereof may occur to an artisan and the scope of the invention should only be limited to the scope of the appended claims.

I claim:

1. A dart board game for use underwater in a pool comprising:

a dart board having a peripheral outer border, an inner peripheral frame spaced from said border forming a generally planar area in the middle of said dart board, a plurality of ribs interconnecting said border to said frame forming spaced annular generally planar areas therebetween, and indicia disposed in said area surrounded by said frame and in the spaced areas between said border and said frame, said border being hollow and having a closable opening leading into the interior thereof for filling the same with a weighted material;

a dart adapted to be thrown on top of said dart board when said dart board border is filled with a weighted material and underwater in a pool, said dart having a weighted end.

2. The dart board game of claim 1 wherein said border and said frame are circular.

3. The dart board game of claim 1 wherein said opening in said border is closed off by a cap attached to said border.

4. The dart board game of claim 1 wherein said dart includes an elongated main body portion having an enlarged hollow member forming said weighted end, said member having a closable opening leading into the interior thereof for filling the member with a weighted material.

5. The dart board game of claim 1 wherein the opposite end of said dart remote from said weighted end is an enlarged hollow air-filled member.

6. The dart board game of claim 1 wherein the opposite end of said dart remote from said weighted end includes a plurality of spaced feathers integral with said main body portion.

7. The dart board game of claim 1 wherein said board and said dart are of plastic.

8. The dart board game of claim 1 wherein said weighted end of said dart is a globe filled with a weighted member.

9. The dart board game of claim 8 wherein said weighted member is sand.

* * * * *